US008890664B2

(12) United States Patent
Edwards et al.

(10) Patent No.: US 8,890,664 B2
(45) Date of Patent: Nov. 18, 2014

(54) SERIAL PROGRAMMING OF A UNIVERSAL REMOTE CONTROL

(75) Inventors: Gregory Edwards, Austin, TX (US); Paul Van Vleck, Austin, TX (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 738 days.

(21) Appl. No.: 12/617,523

(22) Filed: Nov. 12, 2009

(65) Prior Publication Data

US 2011/0109444 A1 May 12, 2011

(51) Int. Cl.
*G08C 19/16* (2006.01)
*G08C 19/28* (2006.01)

(52) U.S. Cl.
CPC ..... *G08C 19/28* (2013.01); *G08C 2201/20* (2013.01); *G08C 2201/30* (2013.01); *G08C 2201/92* (2013.01); *G08C 2201/21* (2013.01)
USPC ..... 340/12.23; 340/12.22; 340/12.24; 340/12.28; 340/12.5; 340/12.52; 340/12.53; 341/176

(58) Field of Classification Search
CPC ..... G08C 19/28; G08C 2201/20; G08C 2201/30; G08C 2201/90; G08C 2201/92; G08C 2201/93; G08C 2201/21; G08C 17/00; G08C 17/02; G08C 23/04; G08C 19/00; G08C 2201/32; G08C 2201/33
USPC ..... 340/12.22–12.29, 12.5, 12.52, 12.53; 341/176
See application file for complete search history.

(56) References Cited

U.S. PATENT DOCUMENTS

| | | | | |
|---|---|---|---|---|
| 4,626,848 | A * | 12/1986 | Ehlers | 340/12.24 |
| 4,825,200 | A * | 4/1989 | Evans et al. | 341/23 |
| 4,999,622 | A * | 3/1991 | Amano et al. | 340/12.24 |
| 5,228,077 | A | 7/1993 | Darbee | |
| 5,255,313 | A | 10/1993 | Darbee | |
| 5,515,052 | A | 5/1996 | Darbee | |
| 6,344,817 | B1 | 2/2002 | Verzulli | |
| 6,437,836 | B1 | 8/2002 | Huang et al. | |
| 6,587,067 | B2 * | 7/2003 | Darbee et al. | 341/176 |
| 6,602,001 | B1 * | 8/2003 | Hatano et al. | 398/106 |
| 6,735,287 | B2 | 5/2004 | Vishik et al. | |
| 6,909,378 | B1 | 6/2005 | Lambrechts et al. | |
| 7,039,397 | B2 | 5/2006 | Chuey | |
| 7,065,184 | B2 | 6/2006 | Vishik et al. | |
| 7,161,524 | B2 * | 1/2007 | Nguyen | 341/176 |
| 7,272,145 | B2 | 9/2007 | Chen et al. | |
| D562,806 | S | 2/2008 | Bruce et al. | |
| 7,415,502 | B2 | 8/2008 | Vishik et al. | |
| 7,463,164 | B2 * | 12/2008 | Williams et al. | 340/12.24 |
| 7,525,473 | B2 * | 4/2009 | Chu et al. | 341/176 |
| 7,568,149 | B2 | 7/2009 | Edwards et al. | |

(Continued)

*Primary Examiner* — Steven Lim
*Assistant Examiner* — Ryan Sherwin
(74) *Attorney, Agent, or Firm* — Jackson Walker L.L.P.

(57) ABSTRACT

A method and system for programming a universal remote control (URC) to operate with a remote-controlled device is disclosed. After initiating a serial programming mode on the URC, a user may be instructed to operate a plurality of control elements of an original remote control (ORC) of the remote-controlled device in a predetermined sequence. As a result of operating the ORC control elements, a plurality of programming codes for the remote-controlled device may be received by the URC. Alternatively, the ORC may be requested to transmit a plurality of programming codes for the remote-controlled device. The URC may be configured to use at least one of the programming codes to remotely control the remote-controlled device.

17 Claims, 6 Drawing Sheets

(56) References Cited

U.S. PATENT DOCUMENTS

| | | | | |
|---|---|---|---|---|
| 7,586,398 | B2 | 9/2009 | Huang et al. | |
| D603,842 | S | 11/2009 | Bruce et al. | |
| 7,630,478 | B2 | 12/2009 | Vishik et al. | |
| 7,668,889 | B2 | 2/2010 | Edwards et al. | |
| 7,681,194 | B2 * | 3/2010 | Van Ee et al. | 718/100 |
| 7,746,884 | B2 | 6/2010 | Van Vleck et al. | |
| 7,778,263 | B2 | 8/2010 | Chen et al. | |
| 7,860,962 | B2 | 12/2010 | White et al. | |
| 7,873,102 | B2 | 1/2011 | Van Vleck et al. | |
| 7,889,095 | B1 * | 2/2011 | Harris et al. | 340/4.3 |
| 2003/0095641 | A1 | 5/2003 | Vishik et al. | |
| 2003/0097413 | A1 | 5/2003 | Vishik et al. | |
| 2004/0010602 | A1 | 1/2004 | Van Vleck et al. | |
| 2004/0022247 | A1 | 2/2004 | Chen et al. | |
| 2004/0155793 | A1 | 8/2004 | Mui | |
| 2004/0247089 | A1 | 12/2004 | Vishik et al. | |
| 2006/0203973 | A1 | 9/2006 | Vishik et al. | |
| 2006/0251094 | A1 | 11/2006 | Van Vleck et al. | |
| 2007/0025449 | A1 | 2/2007 | Van Vleck et al. | |
| 2007/0038773 | A1 | 2/2007 | White et al. | |
| 2007/0130588 | A1 | 6/2007 | Edwards et al. | |
| 2007/0294737 | A1 | 12/2007 | Edwards et al. | |
| 2008/0019386 | A1 | 1/2008 | Chen et al. | |
| 2008/0165283 | A1 | 7/2008 | Brandt et al. | |
| 2008/0189736 | A1 | 8/2008 | Edwards et al. | |
| 2008/0235745 | A1 | 9/2008 | Edwards et al. | |
| 2008/0250468 | A1 | 10/2008 | Sullivan et al. | |
| 2009/0019542 | A1 | 1/2009 | Vishik et al. | |
| 2009/0025025 | A1 | 1/2009 | Van Vleck | |
| 2009/0132355 | A1 | 5/2009 | Begeja et al. | |
| 2009/0158369 | A1 | 6/2009 | Van Vleck | |
| 2010/0041374 | A1 | 2/2010 | Vishik et al. | |
| 2010/0057575 | A1 | 3/2010 | Begeja et al. | |
| 2010/0058381 | A1 | 3/2010 | Begeja et al. | |
| 2010/0063863 | A1 | 3/2010 | Begeja et al. | |
| 2010/0122285 | A1 | 5/2010 | Begeja et al. | |
| 2010/0122286 | A1 | 5/2010 | Begeja et al. | |
| 2010/0125586 | A1 | 5/2010 | Van Vleck et al. | |
| 2010/0145766 | A1 | 6/2010 | Begeja et al. | |
| 2010/0208145 | A1 * | 8/2010 | VanDuyn et al. | 348/734 |
| 2010/0223549 | A1 | 9/2010 | Edwards | |
| 2011/0037574 | A1 | 2/2011 | Pratt et al. | |
| 2011/0037611 | A1 | 2/2011 | Van Vleck et al. | |
| 2011/0037635 | A1 | 2/2011 | Van Vleck et al. | |
| 2011/0037637 | A1 | 2/2011 | Van Vleck et al. | |
| 2011/0047284 | A1 | 2/2011 | White et al. | |
| 2011/0075727 | A1 | 3/2011 | Van Vleck et al. | |
| 2011/0090085 | A1 | 4/2011 | Belz et al. | |
| 2011/0093876 | A1 | 4/2011 | Belz et al. | |
| 2011/0093908 | A1 | 4/2011 | Van Vleck et al. | |
| 2011/0109444 | A1 * | 5/2011 | Edwards et al. | 340/12.23 |
| 2011/0115664 | A1 | 5/2011 | Belz et al. | |

* cited by examiner

SERIAL PROGRAMMING OF A UNIVERSAL REMOTE CONTROL

BACKGROUND

1. Field of the Disclosure

The present disclosure relates to remote control devices and, more particularly, to serial programming of universal remote control devices.

2. Description of the Related Art

Remote control devices provide convenient operation of equipment from a distance. Many consumer electronic devices are equipped with remote control features. Universal remote control devices may be configured to control different pieces of equipment.

DESCRIPTION OF THE EMBODIMENT(S)

Figure 1:
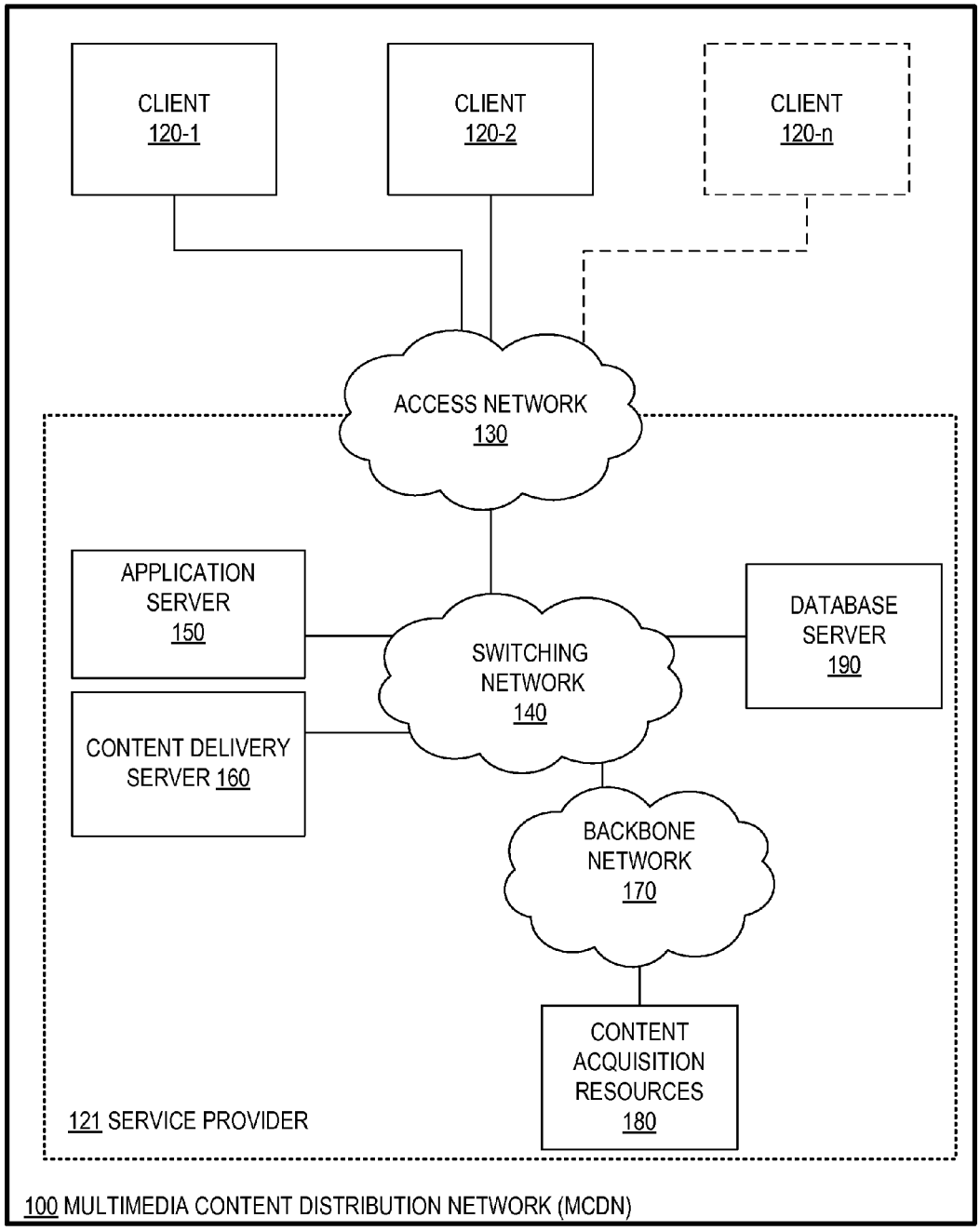
FIG. 1 is a block diagram of selected elements of an embodiment of a multimedia distribution network.

In one aspect, a disclosed method for configuring a universal remote control (URC) over a multimedia content distribution network (MCDN) includes receiving user input to initiate serial programming of the URC. The serial programming may include iteratively performing a number of steps for each of a plurality of programming codes. The steps in the serial programming may include receiving one of the programming codes from an original remote control (ORC) for a remote-controlled device, and configuring the URC to associate the programming code with a URC control element and to generate the programming code when the URC control element is activated. The programming code may correspond to an ORC control element.

In specific embodiments, the method operation for receiving one of the programming codes may include displaying a prompt to a user indicating the ORC control element to operate, and, after the user operates the ORC control element, receiving a programming code from the ORC corresponding to the ORC control element. The method operation for receiving one of the programming codes may include displaying a prompt to a user to operate a plurality of ORC control elements. The method operation for receiving one of the programming codes may include sending a request to the ORC to transmit one of the plurality of programming codes. The plurality of programming codes may have a predetermined ordering, while the method operation for iteratively performing the steps may include iteratively performing the steps for each of the programming codes according to the predetermined ordering.

In particular embodiments, the method also includes determining an identity of the remote-controlled device based on the received programming codes. The method may further include displaying the identity of the remote-controlled device to the user, and receiving a confirmation from the user acknowledging the identity. The method may still further include displaying a confirmation indicating that the URC has been successfully configured with at least one of the programming codes, and receiving user input to terminate the serial programming of the URC. The URC may be programmed using a wireless communication link. The URC may be configured to operate with customer premises equipment (CPE) associated with an MCDN. The method may yet further include sending a command to control the remote-controlled device, wherein the command is associated with at least one of the programming codes.

In a further aspect, a disclosed URC for use within a client configuration of an MCDN includes a processor, a remote control interface, and memory media accessible to the processor, including instructions executable by the processor. Responsive to receiving user input, the processor executable instructions may be executable to initiate serial programming of the URC. The processor instructions executable to serially program may include processor instructions executable to receive a plurality of programming codes in a predetermined sequence from an ORC corresponding to a remote-controlled device, and configure the URC to operate the remote-controlled device by programming the URC to use at least one of the plurality of programming codes.

In one embodiment, the processor instructions to receive the plurality of programming codes may further include processor executable instructions to, for each of the plurality of programming codes, prompt a user to operate an ORC control element, and receive a programming code from the ORC corresponding to the ORC control element. The processor instructions to receive the plurality of programming codes may further include processor executable instructions to prompt a user to operate a plurality of ORC control elements according to the predetermined sequence. The processor instructions to receive the plurality of programming codes may further include processor executable instructions to send a message to the ORC instructing the ORC to transmit the plurality of programming codes.

In given embodiments, the URC may further include processor executable instructions to send, via the remote control interface, a command to control the remote-controlled device, while the command may be associated with at least one of the programming codes. The URC may further include a plurality of URC control elements, while the user input to initiate programming may be received from one of the plurality of URC control elements. The processor instructions to configure the URC may further include processor instructions executable to assign a URC control element to a received programming code.

In yet another aspect, a disclosed computer-readable memory media includes executable instructions for configuring a URC. The instructions may be executable to initiate serial programming of the URC in response to user input. The instructions to serial program may include instructions executable to receive a plurality of programming codes for a remote-controlled device from an ORC associated with a remote-controlled device, and associate each of the programming codes with an ORC control element. The instructions to serially program may further include instructions executable to configure the URC to operate the remote-controlled device by programming the URC to use the plurality of programming codes, including instructions executable to assign one of the programming codes to a URC control element, while the URC control element may correspond to the respective ORC control element for the programming code.

In certain embodiments, the memory media may further include instructions executable to send, from the URC, a command to control the remote-controlled device, wherein the command is associated with at least one of the plurality of programming codes.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, for example, widget 12-1 refers to an instance of a widget class, which may be referred to collectively as widgets 12 and any one of which may be referred to generically as a widget 12.

Turning now to the drawings, FIG. 1 is a block diagram illustrating selected elements of an embodiment of MCDN 100. Although multimedia content is not limited to TV, video on demand (VOD), or pay-per-view (PPV) programs, the depicted embodiments of MCDN 100 and its capabilities are primarily described herein with reference to these types of multimedia content, which are interchangeably referred to herein as "multimedia content", "multimedia content programs", "multimedia programs" or, simply, "programs."

The elements of MCDN 100 illustrated in FIG. 1 depict network embodiments with functionality for delivering multimedia content to a set of one or more subscribers. It is noted that different embodiments of MCDN 100 may include additional elements or systems (not shown in FIG. 1 for clarity) as desired for additional functionality, such as data processing systems for billing, content management, customer support, operational support, or other business applications.

As depicted in FIG. 1, MCDN 100 includes one or more clients 120 and a service provider 121. Each client 120 may represent a different subscriber of MCDN 100. In FIG. 1, a plurality of n clients 120 is depicted as client 120-1, client 120-2 to client **120-*n*, where n may be a large number. Service provider 121 as depicted in FIG. 1 encompasses resources to acquire, process, and deliver programs to clients 120 via access network 130. Such elements in FIG. 1 of service provider 121 include content acquisition resources 180 connected to switching network 140 via backbone network 170, as well as application server 150, database server 190, and content delivery server 160, also shown connected to switching network 140**.

Access network 130 demarcates clients 120 and service provider 121, and provides at least one connection path between clients 120 and service provider 121. In some embodiments, access network 130 is an Internet protocol (IP) compliant network. In some embodiments, access network 130 is, at least in part, a coaxial cable network. It is noted that in some embodiments of MCDN 100, access network 130 is owned and/or operated by service provider 121. In other embodiments, a third party may own and/or operate at least a portion of access network 130.

In IP-compliant embodiments of access network 130, access network 130 may include a physical layer of unshielded twisted pair cables, fiber optic cables, or a combination thereof. MCDN 100 may include digital subscriber line (DSL) compliant twisted pair connections between clients 120 and a node (not depicted) in access network 130 while fiber, cable or another broadband medium connects service provider resources to the node. In other embodiments, the broadband cable may extend all the way to clients 120.

As depicted in FIG. 1, switching network 140 provides connectivity for service provider 121, and may be housed in a central office or other facility of service provider 121. Switching network 140 may provide firewall and routing functions to demarcate access network 130 from the resources of service provider 121. In embodiments that employ DSL-compliant connections, switching network 140 may include elements of a DSL Access Multiplexer (DSLAM) that multiplexes many subscriber DSLs to backbone network 170.

In FIG. 1, backbone network 170 represents a private network including, as an example, a fiber based network to accommodate high data transfer rates. Content acquisition resources 180 as depicted in FIG. 1 encompass the acquisition of various types of content including broadcast content, other "live" content including national content feeds, and VOD content.

Thus, the content provided by service provider 121 encompasses multimedia content that is scheduled in advance for viewing by clients 120 via access network 130. Such multimedia content, also referred to herein as "scheduled programming," may be selected using an electronic programming guide (EPG), such as EPG 316 described below with respect to FIG. 3. Accordingly, a user of MCDN 100 may be able to browse scheduled programming well in advance of the broadcast date and time. Some scheduled programs may be "regularly" scheduled programs, which recur at regular intervals or at the same periodic date and time (i.e., daily, weekly, monthly, etc.). Programs which are broadcast at short notice or interrupt scheduled programs are referred to herein as "unscheduled programming."

Acquired content is provided to content delivery server 160 via backbone network 170 and switching network 140. Content may be delivered from content delivery server 160 to clients 120 via switching network 140 and access network 130. Content may be compressed, encrypted, modulated, demodulated, and otherwise encoded or processed at content acquisition resources 180, content delivery server 160, or both. Although FIG. 1 depicts a single element encompassing acquisition of all content, different types of content may be acquired via different types of acquisition resources. Similarly, although FIG. 1 depicts a single content delivery server 160, different types of content may be delivered by different servers. Moreover, embodiments of MCDN 100 may include content acquisition resources in regional offices that are connected to switching network 140.

Although service provider 121 is depicted in FIG. 1 as having switching network 140 to which content acquisition resources 180, content delivery server 160, and application server 150 are connected, other embodiments may employ different switching networks for each of these functional components and may include additional functional components (not depicted in FIG. 1) including, for example, operational subsystem support (OSS) resources.

FIG. 1 also illustrates application server 150 connected to switching network 140. As suggested by its name, application server 150 may host or otherwise implement one or more applications for MCDN 100. Application server 150 may be any data processing system with associated software that provides applications for clients or users. Application server 150 may provide services including multimedia content services, e.g., EPGs, digital video recording (DVR) services, VOD programs, PPV programs, IPTV portals, digital rights management (DRM) servers, navigation/middleware servers, conditional access systems (CAS), and remote diagnostics, as examples.

Applications provided by application server 150 may be downloaded and hosted on other network resources including, for example, content delivery server 160, switching network 140, and/or on clients 120. Application server 150 is configured with a processor and storage media (not shown in FIG. 1) and is enabled to execute processor instructions, such as those included within a software application. As depicted in FIG. 1, application server 150 may be configured to include various applications (not shown in FIG. 1) that may provide functionality to clients 120.

Further depicted in FIG. 1 is database server 190, which provides hardware and software resources for data warehousing. Database server 190 may communicate with other elements of the resources of service provider 121, such as application server 150 or content delivery server 160, in order to store and provide access to large volumes of data, information, or multimedia content. In some embodiments, database server 190 includes a data warehousing application, accessible via switching network 140, that can be used to record and access structured data, such as program or channel metadata for clients 120. Database server 190 may also store device information, such as identifiers for client 120, model identifiers for remote control devices, identifiers for peripheral devices, etc.

Figure 2:
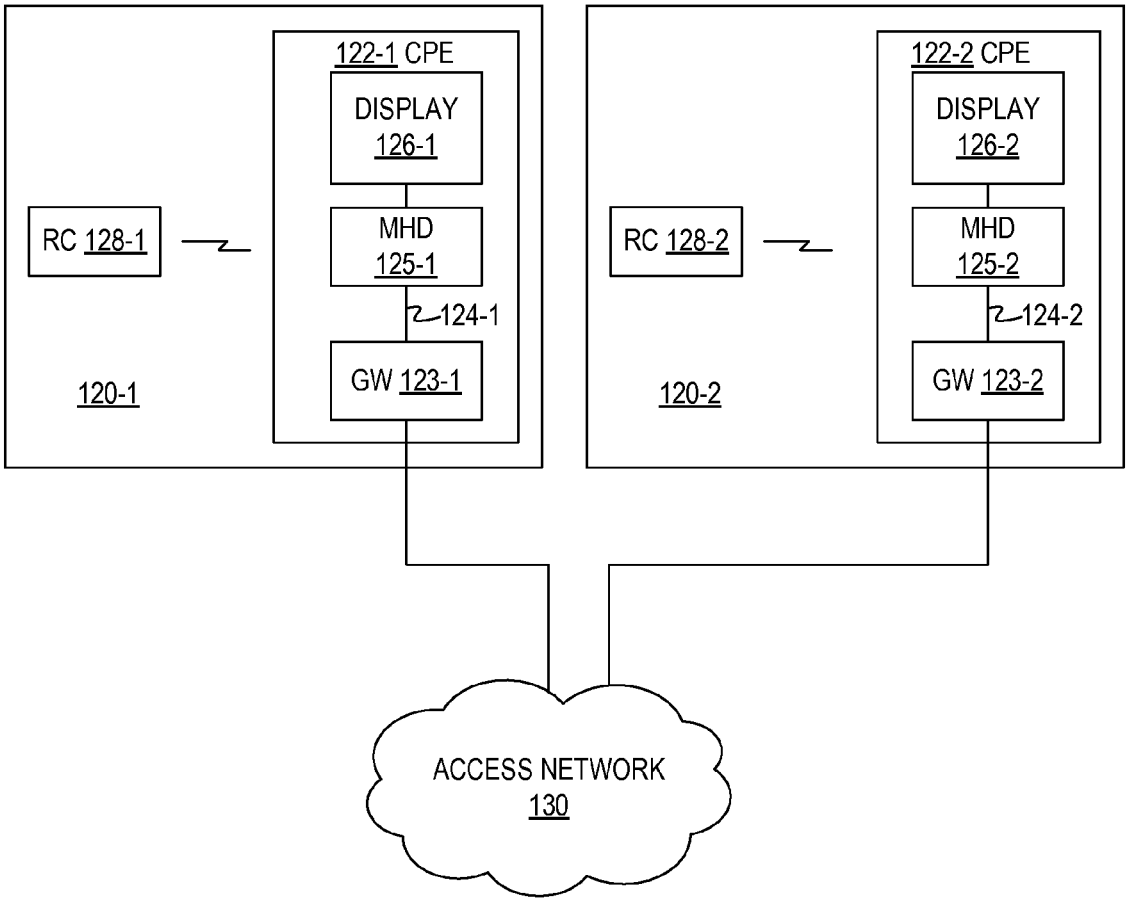
FIG. 2 is a block diagram of selected elements of an embodiment of a multimedia distribution network.

Turning now to FIG. 2, clients 120 are shown in additional detail with respect to access network 130. Clients 120 may include network appliances collectively referred to herein as CPE 122. In the depicted embodiment, CPE 122 includes the following devices: gateway (GW) 123, multimedia handling device (MHD) 125, and display device 126. Any combination of GW 123, MHD 125, and display device 126 may be integrated into a single physical device. Thus, for example, CPE 122 might include a single physical device that integrates GW 123, MHD 125, and display device 126. As another example, MHD 125 may be integrated into display device 126, while GW 123 is housed within a physically separate device.

In FIG. 2, GW 123 provides connectivity for client 120 to access network 130. GW 123 provides an interface and conversion function between access network 130 and client-side local area network (LAN) 124. GW 123 may include elements of a conventional DSL or cable modem. GW 123, in some embodiments, may further include routing functionality for routing multimedia content, conventional data content, or a combination of both in compliance with IP or another network layer protocol. In some embodiments, LAN 124 may encompass or represent an IEEE 802.3 (Ethernet) LAN, an IEEE 802.11-type (WiFi) LAN, or a combination thereof. GW 123 may still further include WiFi or another type of wireless access point to extend LAN 124 to wireless-capable devices in proximity to GW 123. GW 123 may also provide a firewall (not depicted) between clients 120 and access network 130.

Clients 120 as depicted in FIG. 2 further include a display device or, more simply, a display 126. Display 126 may be implemented as a TV, a liquid crystal display screen, a computer monitor, or the like. Display 126 may comply with a display standard such as National Television System Committee (NTSC), Phase Alternating Line (PAL), or another suitable standard. Display 126 may include one or more integrated speakers to play audio content.

Clients 120 are further shown with their respective remote control 128, which is configured to control the operation of MHD 125 by means of a user interface (not shown in FIG. 2) displayed on display 126. Remote control 128 of client 120 is operable to communicate requests or commands wirelessly to MHD 125 using infrared (IR) or radio frequency (RF) signals. MHDs 125 may also receive requests or commands via buttons (not depicted) located on side panels of MHDs 125.

In some embodiments, remote control 128 may represent a device that is configured to control multiple pieces of equipment. When the equipment controlled by remote control 128 changes, remote control 128 may be reprogrammed, for example, to add a new device. Remote control 128 may be programmed using a local transceiver (see FIG. 3) coupled to CPE 122.

MHD 125 is enabled and configured to process incoming multimedia signals to produce audio and visual signals suitable for delivery to display 126 and any optional external speakers (not depicted in FIG. 2). Incoming multimedia signals received by MHD 125 may be compressed and/or encrypted, digital or analog, packetized for delivery over packet switched embodiments of access network 130 or modulated for delivery over cable-based access networks. In some embodiments, MHD 125 may be implemented as a stand-alone set top box suitable for use in a coaxial or IP-based MCDN.

Figure 3:
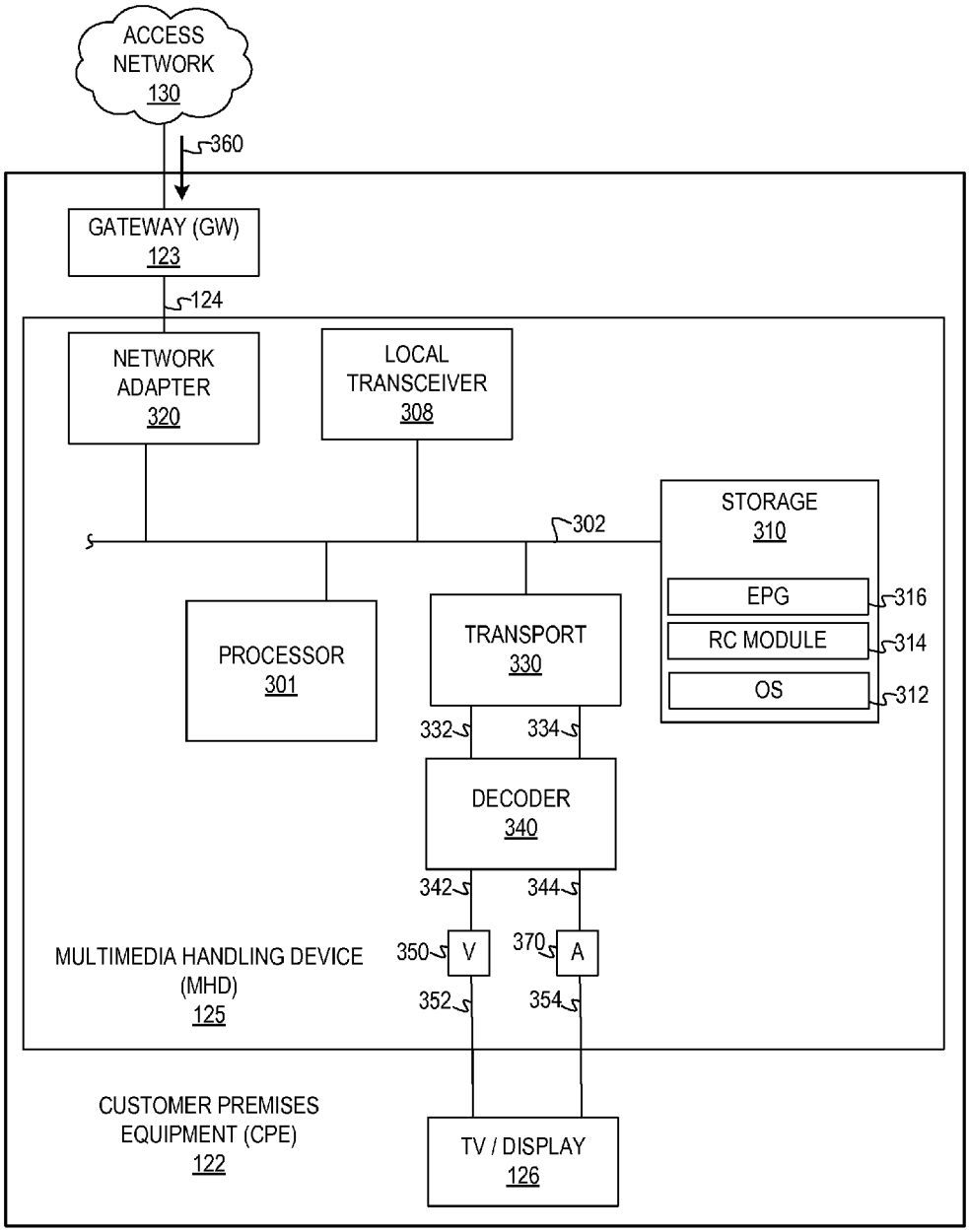
FIG. 3 is a block diagram of selected elements of an embodiment of a multimedia handling device.

Referring now to FIG. 3, a block diagram illustrating selected elements of an embodiment of MHD 125 is presented. In FIG. 3, MHD 125 is shown as a functional component of CPE 122 along with GW 123 and display 126, independent of any physical implementation, as discussed above with respect to FIG. 2. In particular, it is noted that CPE 122 may be any combination of GW 123, MHD 125 and display 126.

In the embodiment depicted in FIG. 3, MHD 125 includes processor 301 coupled via shared bus 302 to storage media collectively identified as storage 310. MHD 125, as depicted in FIG. 3, further includes network adapter 320 that interfaces MHD 125 to LAN 124 and through which MHD 125 receives multimedia content 360. GW 123 is shown providing a bridge between access network 130 and LAN 124, and receiving multimedia content 360 from access network 130.

In embodiments suitable for use in IP-based content delivery networks, MHD 125, as depicted in FIG. 3, may include transport unit 330 that assembles the payloads from a sequence or set of network packets into a stream of multimedia content. In coaxial-based access networks, content may be delivered as a stream that is not packet-based and it may not be necessary in these embodiments to include transport unit 330. In a coaxial implementation, however, clients 120 may require tuning resources (not explicitly depicted in FIG. 3) to "filter" desired content from other content that is delivered over the coaxial medium simultaneously and these tuners may be provided in MHDs 125. The stream of multimedia content received by transport unit 330 may include audio information and video information and transport unit 330 may parse or segregate the two to generate video stream 332 and audio stream 334 as shown.

Video and audio streams 332 and 334, as output from transport unit 330, may include audio or video information that is compressed, encrypted, or both. A decoder unit 340 is shown as receiving video and audio streams 332 and 334 and generating native format video and audio streams 342 and 344. Decoder 340 may employ any of various widely distributed video decoding algorithms including any of the Motion Pictures Expert Group (MPEG) standards, or Windows Media Video (WMV) standards including WMV 9, which has been standardized as Video Codec-1 (VC-1) by the Society of Motion Picture and Television Engineers. Similarly decoder 340 may employ any of various audio decoding algorithms including Dolby® Digital, Digital Theatre System (DTS) Coherent Acoustics, and Windows Media Audio (WMA).

The native format video and audio streams 342 and 344 as shown in FIG. 3 may be processed by encoders/digital-to-analog converters (encoders/DACs) 350 and 370 respectively to produce analog video and audio signals 352 and 354 in a format compliant with display 126, which itself may not be a part of MHD 125. Display 126 may comply with NTSC, PAL or any other suitable television standard.

Storage 310 encompasses persistent and volatile media, fixed and removable media, and magnetic and semiconductor media. Storage 310 is operable to store instructions, data, or both. Storage 310 as shown may include sets or sequences of instructions, namely, an operating system 312, a remote control application program identified as RC module 314, and EPG 316. Operating system 312 may be a UNIX or UNIX-like operating system, a Windows® family operating system, or another suitable operating system. In some embodiments, storage 310 is configured to store and execute instructions provided as services to client 120 by application server 150, as mentioned previously.

EPG 316 represents a guide to the multimedia content provided to client 120 via MCDN 100, and may be shown to the user as an element of the user interface. The user interface may include a plurality of menu items arranged according to one or more menu layouts, which enable a user to operate MHD 125. The user may operate the user interface, including EPG 316, using remote control 128 (see FIG. 2) in conjunction with RC module 314.

Local transceiver 308 represents an interface of MHD 125 for communicating with external devices, such as remote control 128, or another URC device. Local transceiver 308 may provide a mechanical interface for coupling to an external device, such as a plug, socket, or other proximal adapter. In some cases, local transceiver 308 is a wireless transceiver, configured to send and receive IR or RF or other signals. In some embodiments, local transceiver 308 is also used to receive commands for controlling equipment from a URC device. Local transceiver 308 may be accessed by RC module 314 for providing remote control functionality.

Figure 4:
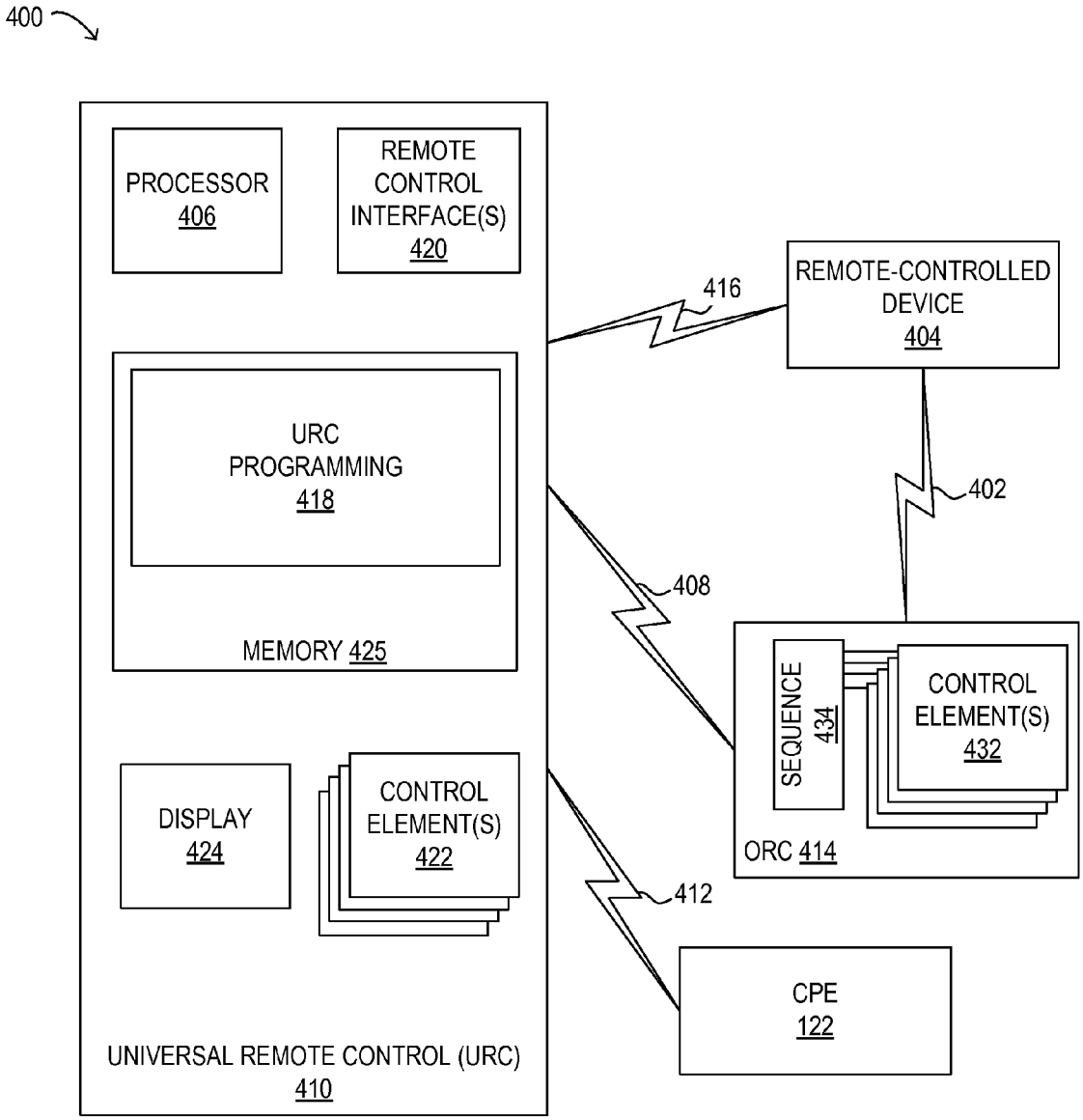
FIG. 4 a block diagram of selected elements of an embodiment of a universal remote control system.

Turning now to FIG. 4, a block diagram of selected elements of an embodiment of URC system 400 is depicted. In URC system 400, ORC 414, URC 410, and CPE 122 may be in proximity to remote-controlled device 404, for example at a location of an MCDN client 120. URC system 400 illustrates devices, interfaces and information that may be processed to program URC 410 to control remote-controlled device 404. The reconfiguring, or reprogramming, of URC 410 may be complex, error prone, or time-consuming for a user. URC system 400 is a platform that may allow a user to reprogram URC 410 using ORC 414. It is noted that in FIG. 4, communication links 402, 408, 412, and 416 may be wireless or mechanically connected interfaces. It is further noted that like numbered elements in FIG. 4 represent components discussed above with respect to FIGS. 1-3.

In FIG. 4, remote-controlled device 404 may refer to a piece of equipment that is introduced for use with or near CPE 122. In some embodiments, remote-controlled device 404 may be controllable by remote control, and may be suitable for control by URC 410. Remote-controlled device 404 may also represent an existing instrument or device that is in use, but not yet controllable using URC 410, because URC 410 may not yet be configured to control remote-controlled device 404. Remote-controlled device 404 may further include one or more local transceivers or interfaces (not explicitly shown in FIG. 4) for communicating with remote controls, or for control by another piece of equipment, as will be described below.

ORC 414 may be a remote control that is dedicated for operation with remote-controlled device 404, for example, via communication link 402. That is, ORC 414 may represent original equipment provided with remote-controlled device 404, such that remote-controlled device 404 and ORC 414 may communicate via communication link 402 as a stand-alone unit. ORC 414 may be configured to use programming codes, or coded instructions, that are specific to remote-controlled device 404. ORC 414 may store programming codes for remote-controlled device 404 in a local memory (not shown in FIG. 4). ORC 414 may further be specific to a device-type (i.e., model, configuration, etc.) corresponding to remote-controlled device 404, such that ORC 414 may be operable with any manufactured instance of a particular device model, represented by remote-controlled device 404. Accordingly, by determining an identity of ORC 414, an identity of remote-controlled device 404 may correspondingly be determined. Furthermore, ORC 414 and/or remote-controlled device 404 may be identifiable by programming codes or other information stored in ORC 414.

As shown in FIG. 4, ORC 414 may include control element (s) 432 (also referred to as ORC control element(s)). Control element(s) 432 may be buttons, sliders, switches or other types of electromechanical input devices. For example, control element(s) 432 may include power control elements for powering ORC 414 on or off. Control element(s) 432 may additionally include control elements that generate remote control commands executable by remote-controlled device 404, such as, but not limited to, info, play, pause, guide, purchase, browse, etc. ORC 414 is also shown including sequence 434, which may provide functionality for arranging, or selecting, control element(s) 432 in a predetermined sequence.

In FIG. 4, URC 410 may communicate with CPE 122 via communication link 412. Communication link 412 may be used to receive remote control commands (i.e., in the form of codes or instructions) from URC 410. Alternatively, communication link 412 may be used to reprogram (i.e., reconfigure) URC 410 to send different commands or to control different equipment. For example, communication link 412 may be used to reconfigure URC 410 to use programming codes corresponding to remote-controlled device 404. In some instances, communication link 412 may be used to limit or delete existing functionality, for which URC 410 may be configured.

As shown in FIG. 4, ORC 414 may communicate with URC 410 via communication link 408. Communication link 408 may be used by URC 410 to receive programming codes from ORC 414 that are specific to remote-controlled device 404. In some embodiments, communication link 408 may be used by URC 410 to receive universal programming code tags from ORC 414 that accompany each of the programming codes and that are specific to the applicable programming code regardless of the remote-controlled device. It is to be noted that regardless of the applicable programming code that may be generated for a particular remote-controlled device, the corresponding universal programming code tag would be the same for the applicable function associated with the programming code (i.e., all programming codes for the "power off" function regardless of the applicable remote-controlled device to which they are associated would have the same universal programming code tag). As will be described in detail below, URC 410 may prompt a user to activate a control element of ORC 414. Such prompting may include activation of control elements of ORC 414 in a specific sequence. Further embodiments include URC 410 instructing ORC 414 to send a plurality of programming codes in an ordered sequence. URC 410 may perform communications via communication link 408 using remote control interface(s) 420 to identify remote-controlled device 404.

In FIG. 4, after URC 410 has been configured with at least some programming codes corresponding to remote-controlled device 404, URC 410 may communicate via communication link 416 with remote-controlled device 404. That is, URC 410 may emulate at least some functionality using communication link 416 that ORC 414 is capable of using communication link 402. From the perspective of remote-controlled device 404, communication links 402 and 416 may appear identical or indistinguishable. In other words, remote-controlled device 404 may not be aware that URC 410 is emulating ORC 414, and may respond to communication links 402 or 416 in an identical manner.

As shown in FIG. 4, URC 410, which may be a hand-held and manually operated device, includes numerous elements, and may include additional elements (not shown in FIG. 4) in various embodiments. In certain implementations, URC 410 may be an embodiment of remote control 128 (see FIG. 2). URC 410 may be capable of controlling multiple pieces of equipment, such as remote-controlled device 404 and/or CPE 122. Accordingly, URC 410 may be configured or reconfigured to control a given set of remote-controlled devices, for example, by adding new remote-controlled devices to the set, and/or by removing existing remote-controlled devices from the set. URC 410 may store the set of remote-controlled devices for which it is configured to control in memory 425.

URC 410 is shown further including processor 406, remote control interface(s) 420, memory 425, and control element(s) 422. Memory 425 is depicted in FIG. 4 including URC programming 418. Accordingly, URC 410 may comprise elements configured to function as an embodiment of an electronic device capable of executing program instructions. URC 410 may further include at least one shared bus (not shown in FIG. 4) for interconnectivity among internal elements, such as those depicted in FIG. 4.

Processor 406 may represent at least one processing unit and may further include internal memory, such as a cache for storing processor executable instructions. In certain embodiments, processor 406 serves as a main controller for URC 410. Processor 406 may access other elements in URC 410 and may provide for internal communications between elements in URC 410.

In FIG. 4, remote control interface(s) 420 may represent a communications transceiver providing an interface for any of a number of communication links. In certain embodiments, remote control interface(s) 420 supports wireless communication links, such as IR, RF, and audio, among others. Remote control interface(s) 420 may further support mechanically connected communication links to remote controls, such as galvanically wired connections, and may accordingly include a physical adapter or receptacle for receiving such connections. In one embodiment, remote control interface(s) 420 transforms an instruction for operating remote-controlled device 404 into a signal sent via communication link 416. It is noted that remote control interface(s) 420 may be a bidirectional interface, such that responses, such as commands, information, or acknowledgements, may be received from remote-controlled device 404 via communication link 416. In one embodiment, a message may be sent to remote-controlled device 404 and an acknowledgement of the message may be received from remote-controlled device 404. The message may include command data, as will be described below. Remote control interface(s) 420 may further be configured to receive programming codes for configuring URC 410 to control a new remote-controlled device, such as remote-controlled device 404.

Also in FIG. 4, memory 425 encompasses persistent and volatile media, fixed and removable media, magnetic and semiconductor media, or a combination thereof. Memory 425 is operable to store instructions, data, or both. Memory 425 may represent URC memory immovably integrated into the URC, for example by soldering a semiconductor device to a circuit board of URC 410. Memory 425 as shown includes data, which may be in the form of sets or sequences of instructions, namely, URC programming 418. URC programming 418 may include processor executable instructions to configure URC 410 to control remote-controlled device 404, as described herein. Memory 425 may also include device information for a variety of different remote-controlled devices, which may be controllable by URC 410. The device information may include programming codes for specific remote-controlled devices. In some embodiments, the device information may include information for a majority of known remote-controlled devices that are available for purchase by consumers.

URC 410, as depicted in FIG. 4, includes control element (s) 422, representing a variety of input control elements integrated into URC 410. Control element(s) 422 may be buttons, sliders, switches or other types of electromechanical input devices. For example, control element(s) 422 may include power control elements for powering URC 410 on or off Control element(s) 422 may additionally include control elements that generate remote control commands executable by remote-controlled device 404, such as, but not limited to, info, play, pause, guide, purchase, browse, etc. In certain embodiments, control element(s) 422 may include control elements associated with a remote control context (not shown in FIG. 4) executing on remote-controlled device 404. The remote control context may be in the form of a displayed menu structure that is responsive to control element(s) 422. In particular, control element(s) 422 may include functionality to select an activated item in the remote control context.

In certain embodiments, URC 410 may further include a display element, referred to as display 424, which may represent a display device implemented as a liquid crystal display screen, a computer monitor, a television, a touch screen device, or the like. Display 424 may comply with a display standard for the corresponding type of display. Standards for computer monitors include analog standards such as video graphics array (VGA), extended graphics array (XGA), etc., or digital standards such as digital visual interface (DVI) or high-definition multimedia interface (HDMI), among others. A television display may comply with standards such as NTSC, PAL, or another suitable standard.

In operation of URC system 400, as shown in FIG. 4, a user (not shown) may initiate a URC configuration request for configuring URC 410 to control remote-controlled device 404. The URC configuration request, which may be initiated by activating one of control element(s) 422, may cause URC 410 to transition to a serial programming mode or state. The serial programming mode may be a state in which URC 410 is receptive to input via remote control interface(s) 420. The input may provide URC 410 with programming codes for remote-controlled device 404 and may be received by URC 410 using various methods.

In one embodiment, the user may then be prompted, for example, via display 424, to activate one of control element(s) 432 of ORC 414, thereby causing a first input to be received by URC 410 at remote control interface(s) 420. The user may be prompted to operate ORC 414 via communication link 408, that is, directed to remote control interface(s) 420 of URC 410 without any participation by remote-controlled device 404. In other embodiments, URC 410 may 'listen' to ORC 414 communicating with remote-controlled device 404, such that communication link 408 may represent URC 410 'eavesdropping' (i.e., receiving a signal transmitted over communication link 402).

Such actions may provide URC 410 with a programming code (corresponding to the operated ORC control element that generated the programming code) that can be used to identify remote-controlled device 404 and/or ORC 414. URC 410 may use the programming code to query a database (not shown in FIG. 4) for at least one identity of remote-controlled device 404 and/or ORC 414. In certain embodiments, URC 410 may repeat the user prompt to obtain a first code and a second code (or additional codes, as desired). The first code and the second code may be used by URC 410 to query the database (not shown in FIG. 4) to uniquely identify remote-controlled device 404 and/or ORC 414, or to further limit the possible identities of remote-controlled device 404 and/or ORC 414. This process may be repeated for a third and fourth prompt, etc., as desired, until sufficient programming codes have been received.

In certain embodiments, the user may be prompted to activate a series of control element(s) 432 in a predetermined sequence, for example, as given by sequence 434. URC programming 418 may be configured to communicate with ORC 414 to retrieve sequence 434. As the series of control element (s) 432 are activated (i.e., operated), ORC 414 may generate a corresponding series of programming codes and send these to URC 410. In still other embodiments, ORC 414 may be instructed to autonomously send a series of programming codes to URC 410, for example, according to sequence 434. ORC 414 may then send the series of programming codes to URC 410.

Such actions may provide URC 410 with a plurality of programming codes that can be used to identify remote-controlled device 404 and/or ORC 414. URC 410 may use the programming codes to query a database (not shown in FIG. 4) for at least one identity of remote-controlled device 404 and/or ORC 414.

In some embodiments, URC 410 may then display, or otherwise send, at least one potential identity for remote-controlled device 404 and/or ORC 414 to the user. The user may then acknowledge and/or confirm the identity. Next, URC 410 may now use the identity to query a database (not shown in FIG. 4) for additional programming codes and/or assignments of programming codes to control element(s) 422. URC programming 418 may display an indication of being ready to reprogram URC 410. URC programming 418 may then program URC 410 with at least some of the programming codes. In some cases, URC programming 418 may wait for user input before proceeding to configure URC 410. After URC 410 has been programmed, or reprogrammed, URC programming 418 may display an indication that URC 410 has been successfully configured to control remote-controlled device 404. Finally, URC programming 418 may send an acknowledgement to the user that URC 410 has been successfully configured for use with remote-controlled device 404 using communication link 416.

It is noted that URC 410 may maintain a list of remote-controlled devices that it is presently configured to control. URC 410 may display the list of configured remote-controlled devices to the user, for example, for selection to operate. URC 410 may further detect the presence of remote-controlled devices in a vicinity of URC 410.

After being successfully configured, URC 410 may control remote-controlled device 404. In one embodiment, URC 410 may use communication link 416 to directly control remote-controlled device 404. URC 410 may further be configured to respond to user input, such as activation of control element(s) 422, by sending commands (corresponding to certain programming codes) to remote-controlled device 404 via communication link 416. Sending commands to remote-controlled device 404 via communication link 416 may then cause remote-controlled device 404 to execute a function corresponding to the command.

Figure 5:
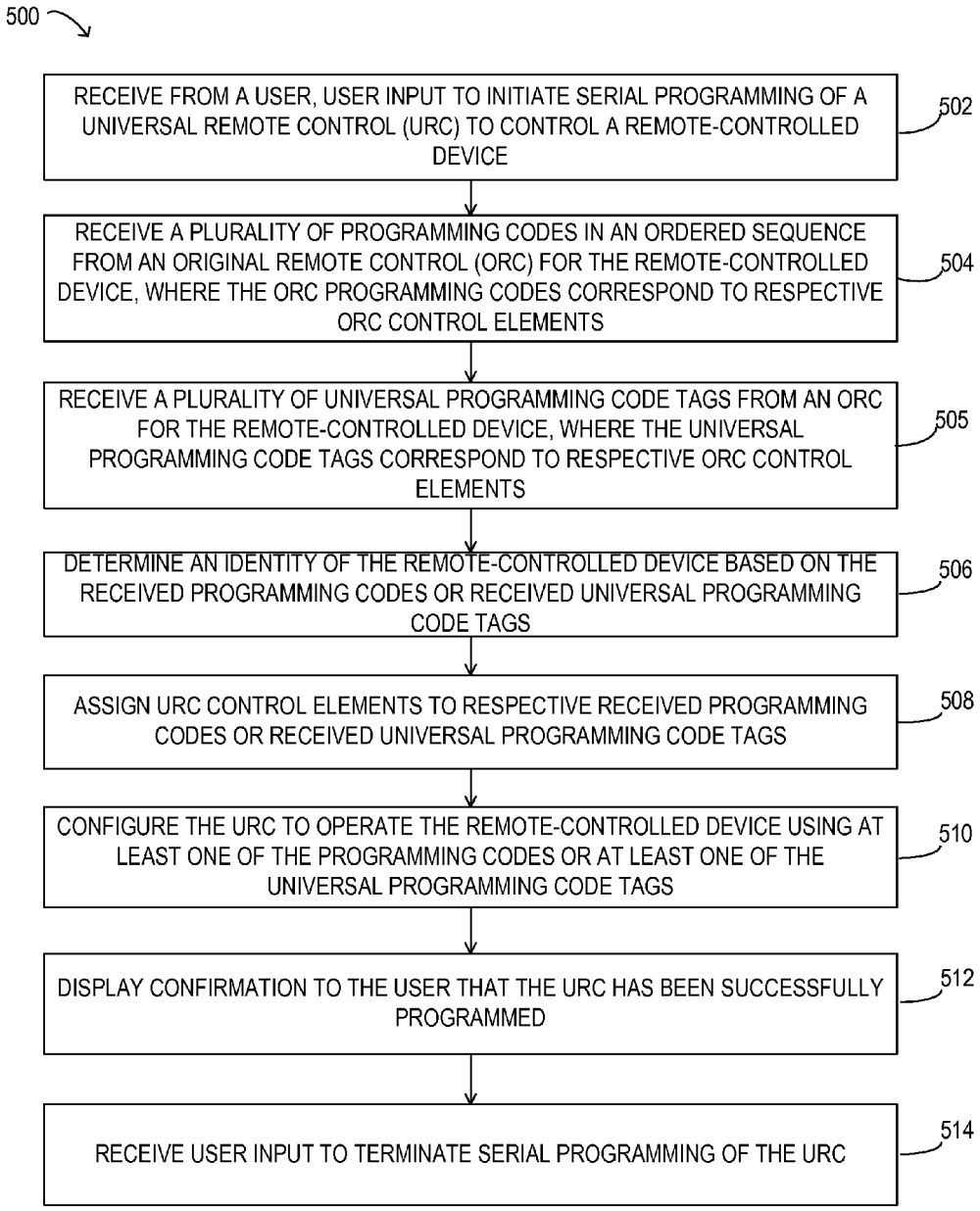
FIG. 5 illustrates an embodiment of a method for programming a universal remote control.

Turning now to FIG. 5, an embodiment of method 500 for programming a URC is illustrated. In one embodiment, method 500 is performed by URC programming 418 executing on URC 410. It is noted that certain operations described in method 500 may be optional or may be rearranged in different embodiments. In method 500, it is assumed that remote-controlled device 404 has been introduced alongside CPE 122 of MCDN client 120, and that URC 410 is capable of controlling remote-controlled device 404 (see FIG. 4).

An indication to initiate serial programming of a URC to control a remote-controlled device may be received from a user (operation 502). A plurality of programming codes for the remote-controlled device, corresponding to respective ORC control elements, may be received in an ordered sequence from an ORC (operation 504). A plurality of universal programming code tags for the programming codes, corresponding to respective ORC control elements, may be received from an ORC (operation 505). An identity of the remote-controlled device may be determined based on the received programming codes or universal programming code tags (operation 506). URC control elements may be assigned to respective received programming codes or universal programming code tags (operation 508). The URC may be configured to operate the remote-controlled device using at least one of the programming codes or at least of the universal programming code tags (operation 510). Confirmation may be displayed to the user that the URC has been successfully programmed or configured (operation 512). Finally, user input may be received to terminate serial programming of the URC (operation 514).

Figure 6A:
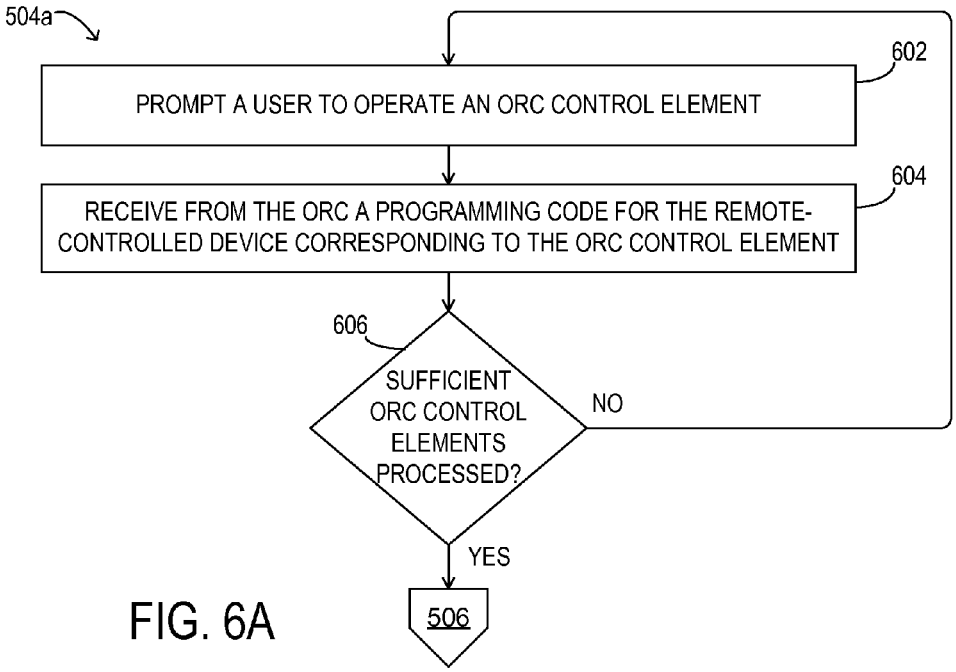
FIG. 6 illustrates an embodiment of a method for programming a universal remote control.

Turning now to FIG. 6A, an embodiment of method 504*a* for programming a URC is illustrated. Method 504*a* may represent an embodiment of operation 504 in method 500, in which at least one programming code is received from the ORC (see FIG. 5). A user may be prompted to operate an ORC control element (operation 602). A programming code, corresponding to the ORC control element, may then be received from the ORC for the remote-controlled device (operation 604). A decision may then be made, if a sufficient number of ORC control elements have been processed (operation 606). If the result of operation 606 is YES, then method 504*a* may terminate and proceed with operation 506 in method 500 (see FIG. 5). If the result of operation 606 is NO, then method 504*a* may loop back to operation 602.

Figure 6B:
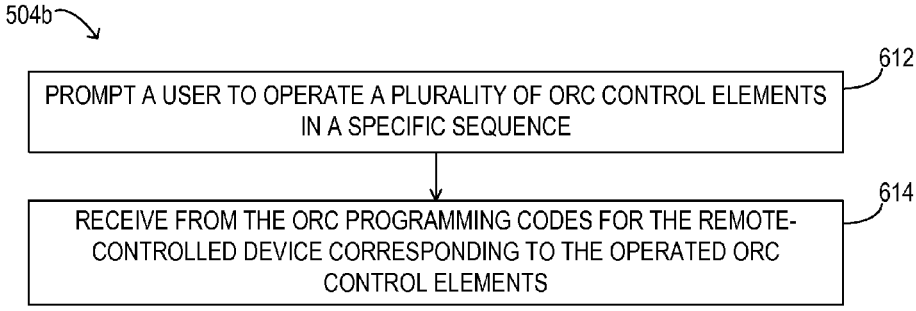

Turning now to FIG. 6B, an embodiment of method 504*b* for programming a URC is illustrated. Method 504*b* may represent an embodiment of operation 504 in method 500, in which a series of programming codes are received from the ORC (see FIG. 5). A user may be prompted to operate a plurality of ORC control elements in a specific sequence (operation 612). Programming codes, corresponding to the operated ORC control elements, may then be received from the ORC for the remote-controlled device (operation 614).

Figure 6C:
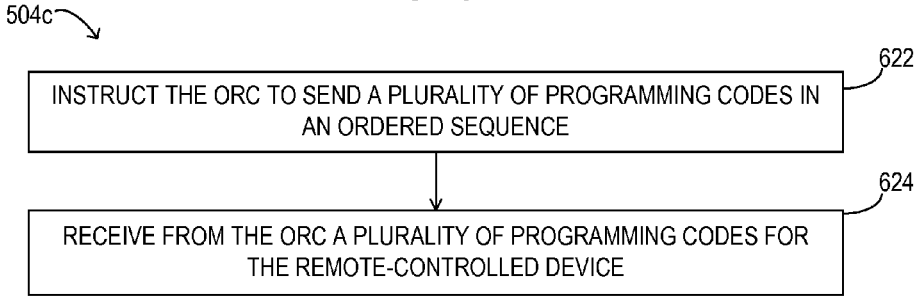

Turning now to FIG. 6C, an embodiment of method 504*c* for programming a URC is illustrated. Method 504*c* may represent an embodiment of operation 504 in method 500, in which a series of programming codes are received from the ORC (see FIG. 5). The ORC may be instructed to send a plurality of ORC control elements in an ordered sequence (operation 622). A plurality of programming codes may then be received from the ORC for the remote-controlled device (operation 624).

To the maximum extent allowed by law, the scope of the present disclosure is to be determined by the broadest permissible interpretation of the following claims and their equivalents, and shall not be restricted or limited to the specific embodiments described in the foregoing detailed description.

What is claimed is:

1. A remote control configuration method, comprising:

receiving user input to initiate serial programming of a universal remote control;

receiving a plurality of programming codes in an ordered sequence from an original remote control for a remote-controlled device, wherein the programming codes correspond to respective original remote control control elements and wherein each control element is selected from: a button, a soft key, and a slide bar; and submitting a query based on the programming codes to a database;

responsive to the query uniquely identifying either the remote-controlled device or the original remote control, performing operations including:

assigning a universal remote control control element to each programming code stored in the database associated with the universal remote control; and responsive to the query not uniquely identifying either the remote-controlled device or the original remote control, repetitively performing operations including:

receiving an additional programming code from the original remote control; and submitting an additional query based on the programming codes including the additional programming code.

2. The method of claim 1, further comprising:

displaying an ordered sequence of prompts to a user, the prompts indicating respective original remote control control elements to operate.

3. The method of claim 2, wherein receiving the plurality of programming codes includes:

receiving a programming code corresponding to each of the ordered sequences of prompts.

4. The method of claim 1, wherein receiving one of the programming codes includes:

sending requests to the original remote control to transmit the plurality of programming codes.

5. The method of claim 1, further comprising:

sending the identity of the remote-controlled device to a display device; and receiving a confirmation acknowledging the identity.

6. The method of claim 1, further comprising:

displaying a confirmation indicating that the universal remote control has been successfully configured with the programming codes; and receiving user input to terminate the serial programming of the universal remote control.

7. The method of claim 1, wherein the universal remote control is programmed using a wireless communication link.

8. The method of claim 1, further comprising operating with customer premises equipment associated with a multimedia content distribution network.

9. The method of claim 1, further comprising:

sending a command to control the remote-controlled device, wherein the command is associated with at least one of the programming codes received.

10. A universal remote control for use within a client configuration of a multimedia content distribution network, comprising:

a processor;

a remote control interface; and memory media, accessible to the processor, including processor executable instructions that, when executed by the processor, cause the processor to perform operations comprising:

receiving user input to initiate serial programming of a universal remote control;

receiving a plurality of programming codes in an ordered sequence from an original remote control for a remote-controlled device, wherein the programming codes correspond to respective original remote control control elements and wherein each control element is selected from: a button, a soft key, and a slide bar; and submitting a query based on the programming codes to a database;

responsive to the query uniquely identifying either the remote-controlled device or the original remote control, performing operations including:

assigning a universal remote control control element to each programming code stored in the database associated with the universal remote control; and responsive to the query not uniquely identifying either the remote-controlled device or the original remote control, repetitively performing operations including:

receiving an additional programming code from the original remote control; and submitting an additional query based on the programming codes including the additional programming code.

11. The universal remote control of claim 10, wherein the operations include:

prompting a user to operate an original remote control control element.

12. The universal remote control of claim 10, wherein receiving the plurality of programming codes includes:

receiving a programming code from the original remote control corresponding to the original remote control control element.

13. The universal remote control of claim 10, wherein receiving the plurality of programming codes includes:

sending a message to the original remote control instructing the original remote control to transmit at least one of the programming codes.

14. The universal remote control of claim 10, wherein the operations include:

sending, via the remote control interface, a command to control the remote-controlled device, wherein the command is associated with at least one of the programming codes.

15. The universal remote control of claim 10, further comprising:

a plurality of universal remote control control elements, wherein the user input to initiate programming is received from one of the plurality of universal remote control control elements.

16. Non-transitory computer-readable memory media, including processor executable instructions that, when executed by a processor, cause the processor to perform operations including:

receiving user input to initiate serial programming of a universal remote control;

receiving a plurality of programming codes in an ordered sequence from an original remote control for a remote-controlled device, wherein the programming codes correspond to respective original remote control control elements and wherein each control element is selected from: a button, a soft key, and a slide bar; and submitting a query based on the programming codes to a database;

responsive to the query uniquely identifying either the remote-controlled device or the original remote control, performing operations including:

assigning a universal remote control control element to each programming code stored in the database associated with the universal remote control; and responsive to the query not uniquely identifying either the remote-controlled device or the original remote control, repetitively performing operations including:

receiving an additional programming code from the original remote control; and submitting an additional query based on the programming codes including the additional programming code.

17. The memory media of claim 16, wherein the operations include:

sending, from the universal remote control, a command to control the remote-controlled device, wherein the command is associated with at least one of the plurality of programming codes.

* * * * *